US005259309A

United States Patent [19]

Stiel et al.

[11] Patent Number: 5,259,309

[45] Date of Patent: Nov. 9, 1993

[54] ADJUSTABLE SHEET GUIDE ASSEMBLY

[75] Inventors: Jürgen A. Stiel, Ostheim; Jürgen F. F. Münker, Würzburg; Karl Preuß, Würzburg; Erich G. Wieland, Würzburg, all of Fed. Rep. of Germany

[73] Assignee: Koenig & Bauer Aktiengesellschaft, Wurzburg, Fed. Rep. of Germany

[21] Appl. No.: 10,579

[22] Filed: Jan. 28, 1993

[30] Foreign Application Priority Data

Jan. 31, 1992 [DE] Fed. Rep. of Germany ..... 4202714
Dec. 17, 1992 [DE] Fed. Rep. of Germany ..... 4242606

[51] Int. Cl.[5] ..... B41F 13/24; B41F 9/00

[52] U.S. Cl. ..... 101/232; 271/8.1; 271/253; 101/142

[58] Field of Search ..... 101/142, 407.1, 154, 101/177, 217, 218, 232; 271/184, 902, 8.1, 226, 253, 256

[56] References Cited

U.S. PATENT DOCUMENTS 3,310,304 3/1967 Folas et al. ..... 271/226
3,712,214 1/1973 Kaneko et al. ..... 101/232
3,960,079 6/1976 Capetil ..... 101/232
5,197,382 3/1993 Goodwin ..... 271/256

FOREIGN PATENT DOCUMENTS 1561101 12/1966 Fed. Rep. of Germany .
1786196 8/1968 Fed. Rep. of Germany .
2657250 12/1976 Fed. Rep. of Germany .
2807295 8/1978 Fed. Rep. of Germany ..... 271/184
57-56262 3/1982 Japan .
0193858 7/1990 Japan ..... 271/184

*Primary Examiner*—Eugene H. Eickholt
*Attorney, Agent, or Firm*—Jones, Tullar & Cooper

[57] ABSTRACT

An adjustable sheet guide assembly utilizes a plurality of individually shiftable sheet guide elements. Each of these sheet guide elements is carried by a sleeve which is concentric about a hollow profile body that carries a rotatable, helically fluted shaft. Guide pins on the sleeves are received in the shaft's flutes so that rotation of the shaft or movement of one sheet guide element causes movement of all of the sheet guide elements in the adjustable sheet guide assembly.

13 Claims, 3 Drawing Sheets

ADJUSTABLE SHEET GUIDE ASSEMBLY

FIELD OF THE INVENTION

The present invention is directed generally to a sheet guide assembly. More particularly, the present invention is directed to an adjustable sheet guide assembly. Most specifically, the present invention is directed to an adjustable sheet guide assembly for a rotary press. A plurality of individual sheet guide elements are placed across the path of sheet travel. These individual sheet guide elements are adjustable in a coordinated manner to increase or decrease their collective width in accordance with the width of the sheet or web of paper that is being printed in the rotary press assembly. The individual sheet guide elements are in engagement with an elongated shaft that carries a plurality of helical flutes or grooves. Rotation of the shaft causes lateral movement of the sheet guide elements.

DESCRIPTION OF THE PRIOR ART

In a sheet or web fed rotary printing press, the sheets or webs being printed are directed from a sheet feeder or a roll stand through one or more printing couples and other ancillary devices. The sheet or web must be guided along its path of travel to insure proper registry and accurate printing. If the width of the sheets or web never changes, the conveying path can be provided with fixed side sheet guide devices. However, since most rotary presses are usable with sheets or webs of various widths, it is necessary to provide sheet guide elements and sheet guide assemblies which are adjustable in accordance with changes in the width of the sheets or web being printed. In the prior art devices, there are shown various arrangements for accomplishing this sheet guide element or assembly adjustment.

In the German published, unexamined patent application No. 26 57 250 there is shown a sheet guiding device for guiding sheets in a perfecting press. The axial adjustment of several sheet guiding bows which are arranged subsequent to each other in the direction of sheet travel is indicated by an adjustment drive. When the adjustment drive is actuated, an adjustment chain is moved over a chain consisting of flat members and a transmission shaft so that a trolley, which is connected with the adjustment chain moves along a tie bar. This prior art sheet guiding device uses a very complicated gear mechanism which becomes even more complicated especially in the case of several sheet guiding devices which are arranged parallel to each other over the width of the machine. This device is sufficiently complex that the joint adjustment of several sheet guiding devices becomes impractical.

Another prior art sheet guiding device is depicted in the German published unexamined patent application No. 15 61 101. In this sheet guiding device for sheet guiding cylinders there are provided sheet guiding bows that have air escape openings which are arranged in the sheet travel direction and generally parallel to each other. In the case of a paper format change, these sheet guiding bows have to be separately adjusted on their supports in accordance with the new paper format. The individual adjustment of each one of the plurality of sheet guiding bows of this prior art device every time there is a paper format change results in the consumption of a large amount of time and this is inconsistent with high volume production requirements.

Another sheet guide or paper hold down assembly is shown in the German published unexamined patent application No. 17 86 196. In this prior art device, as was the case with the previously discussed device, the paper hold down devices of the paper guide assembly are individually adjustable and must each be changed individually in case of a paper format change. The large amount of time that is required by this prior art device is also not acceptable.

It will thus be seen that a need exists for a sheet guide assembly that overcomes the limitations of the prior art devices. The adjustable sheet guide assembly in accordance with the present invention provide such a device and is a significant advance over the prior art.

SUMMARY OF THE INVENTION

It is an object of the present invention to provide a sheet guide assembly.

Another object of the present invention is to provide an adjustable sheet guide assembly.

A further object of the present invention is to provide an adjustable sheet guide assembly for a rotary press.

Yet another object of the present invention is to provide an adjustable sheet guide assembly having a plurality of cooperatively shiftable sheet guide elements.

Still a further object of the present invention is to provide an adjustable sheet guide assembly utilizing a fluted shaft.

Even yet another object of the present invention is to provide an adjustable sheet guide assembly in which individual sheet guide elements in either side of a sheet travel centerline are adjustable in a mirror image manner.

As will be discussed in greater detail in the description of the preferred embodiment which is set forth subsequently, the adjustable sheet guide assembly in accordance with the present invention utilizes a plurality of individual sheet guide elements which are arranged across the path of sheet travel. The plurality of individual sheet guide elements are each secured at first ends to sleeves or rings which overlie an elongated tube or other cooperatively shaped profile body. A rotatable shaft is positioned inside the profile body and has a plurality of generally helical flutes or grooves. The flutes are arranged in mirror image on both sides of a center line of sheet travel. A guide pin that is secured to each sleeve or ring which carries an individual sheet guide element extends into one of the flutes. As the fluted shaft is rotated, either directly or by transverse movement of one of the individual shiftable sheet guide elements, the remainder of the sheet guide elements are also shifted laterally across the sheet travel path.

The adjustable sheet guide assembly of the present invention provides a device which is technically uncomplicated and which does not require a significant amount of space while still facilitating the expeditious adjustment of the sheet guiding elements to a new paper format width. The rotatable shaft which carries the guide pin receiving flutes is located within the profiled body so that it is protected from paper dust and dirt. This hollow profiled body also provides the support for the plurality of individual shiftable sheet guiding elements that are supported at their first ends by the sleeves or rings which are concentric with the hollow profiled body.

The adjustable sheet guide assembly of the present invention provides a quickly adjustable sheet guide arrangement that overcomes the limitations of the prior art devices. It is a substantial advance in the art.

BRIEF DESCRIPTION OF THE DRAWINGS

While the novel features of the adjustable sheet guide assembly in accordance with the present invention are set forth with particularity in the appended claims, a full and complete understanding of the invention may be had by referring to the detailed description of the preferred embodiment which is presented subsequently, and as illustrated in the accompanying drawings in which:

DESCRIPTION OF THE PREFERRED EMBODIMENT

Figure 1:
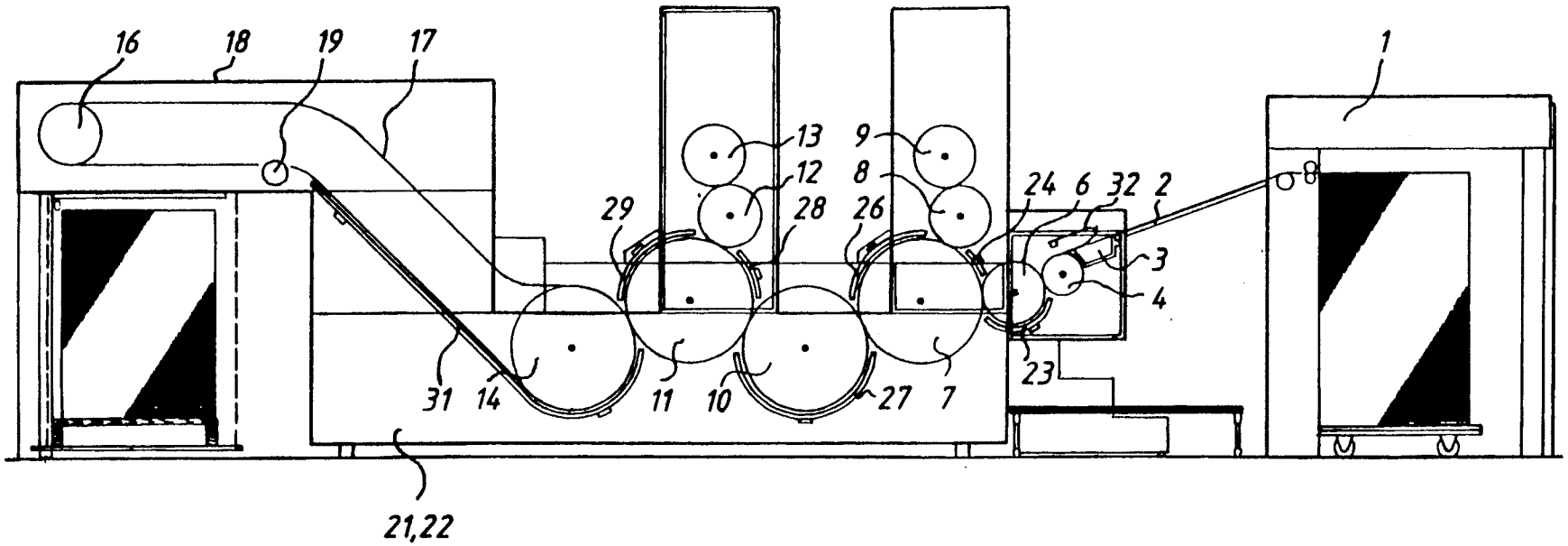
FIG. 1 is a schematic side elevation view of a rotary press utilizing adjustable sheet guide assemblies in accordance with the present invention.

Referring initially to FIG. 1 there may be seen a sheet-fed rotary printing press with two printing couples which utilizes a plurality of the adjustable sheet guide assemblies in accordance with the present invention. In this sheet-fed rotary printing press, a sheet feeder 1 is connected over a sheet feeding path 2 and a tie bar 3 in the sheet feeding path 2 with a stop drum 4. A first printing couple includes a transfer drum 6 and an impression cylinder 7 with a blanket cylinder 8, and a plate cylinder 9 arranged above the impression cylinder 7. Between the first printing couple and a second printing couple, there is a sheet transfer drum 10. Sheet transfer drum 10 is followed by an impression cylinder 11 with a blanket cylinder 12, and a plate cylinder 13 arranged above the impression cylinder 11. The impression cylinder 11 is followed by spaced sprocket wheels 14 and 16 over which a gripper chain system 17 of a sheet delivery 18 is guided. In the sheet delivery 18, there is also arranged a suction roller 19. All of these previously discussed cylinders, drums and the like are supported in spaced side wall 21 and 22 of the machine frame. Inking and dampening units as well as operating elements which are not directly related to the invention, are not represented.

A plurality of adjustable sheet guide assemblies generally at 23, 24, 26, 27 28, 29 and 31 are, as may be seen in FIG. 1 positioned at the circumference of the transfer drum 6, at the impression cylinder 7, the sheet transfer drum 10, the impression cylinder 11, as well as at the sprocket wheel 14 to the suction roller 19; respectively. An additional adjustable sheet guide assembly 32, also in accordance with the present invention, is positioned just before, in the direction of sheet travel, the stop drum 4. This adjustable sheet guide assembly 32 also functions as a sheet hold down.

Figure 2:
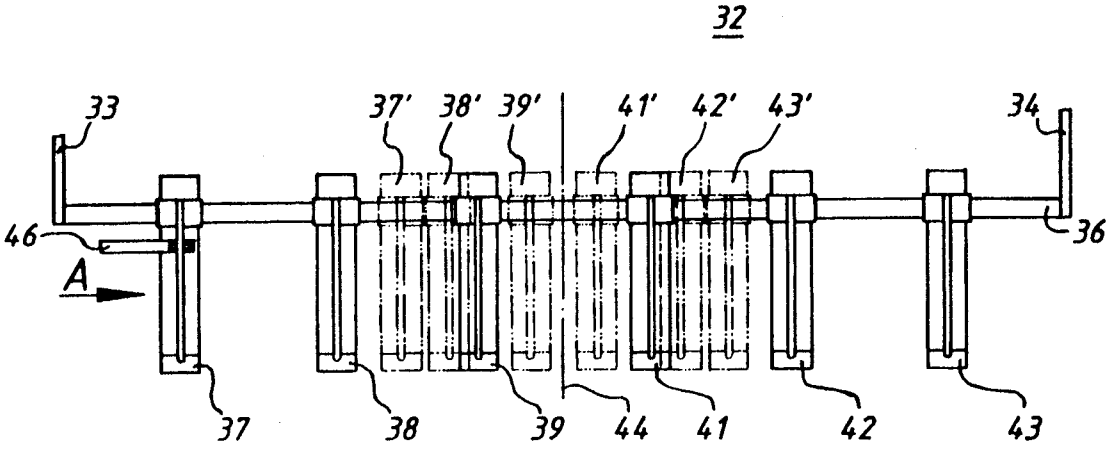
FIG. 2 is a top plan view of one adjustable sheet guide assembly of the present invention.

Turning now to FIG. 2, there is shown a top plan view of the adjustable sheet guide assembly 32 with this assembly 32 being exemplary of the various other adjustable sheet guide assemblies 23, 24, 26, 27, 28, 29 and 31. As may be seen most clearly in FIG. 2, spaced support members 33 and 34 are attached to the press side walls 21 and 22 (not specifically shown) and support between them a hollow profiled body or tube generally at 36. As may also be seen in FIGS. 3 and 4 this hollow profiled body or tube 36 is, in the preferred embodiment, generally square in cross-section.

Again referring primarily to FIG. 2, a plurality of individually shiftable sheet guide elements 37, 38, 39, 41, 42 and 43 are supported on hollow profile body or tube 36. These sheet guide elements are arranged symmetrically about an elongated center line 44 which extends along the middle of the printing press in the direction of sheet travel. Thus individual shiftable sheet guide elements 37, 38 and 39 are on the left of the center line 44 while sheet guide elements 41, 42 and 43 are on the right of the line 44. Since these elements are mirror images of each other about the center line 44, guide elements 37 and 43 are both at the same distance from the center line 44 with respect to each other as are elements 28 and 42 with respect to each other and elements 39 and 41 with respect to each other. In the configuration depicted in FIG. 2 in solid lines, the shiftable sheet guide elements 37, 38, 39; 41, 42 and 43 which are part of the adjustable sheet guide assembly 32 are in their position to guide a sheet having a maximum width format. The individual sheet guide elements 37, 38, 39; 41, 42 and 43 are also depicted in FIG. 2 in dashed lines in their minimum sheet width format. In this minimum width format, the individual sheet guide elements are denoted as 37', 38', 39'; 41', 42' and 43'.

Figure 4:
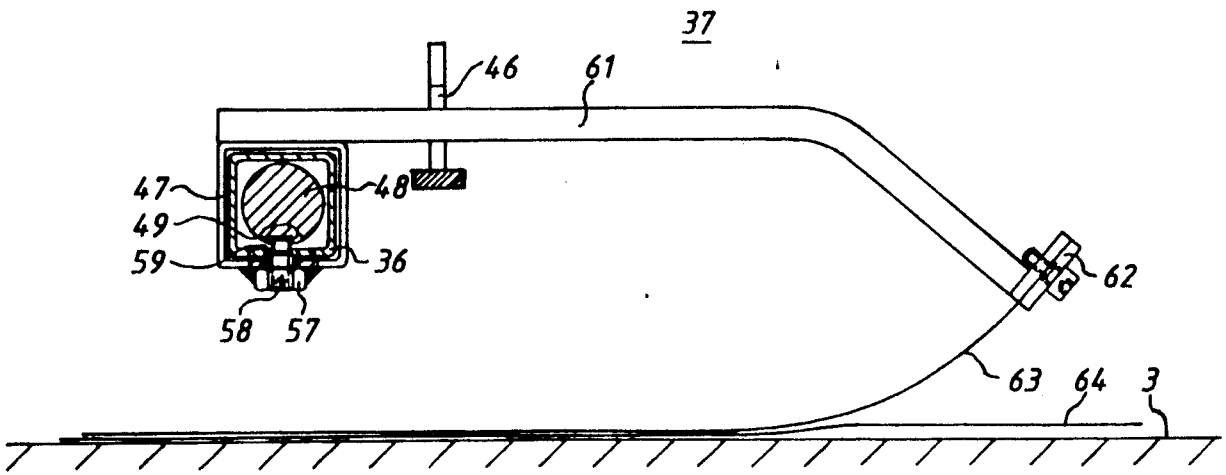
FIG. 4 is a side elevation view, partly in cross-section of a sheet guide element and taken along line IV—IV of FIG. 3.
Figure 3:
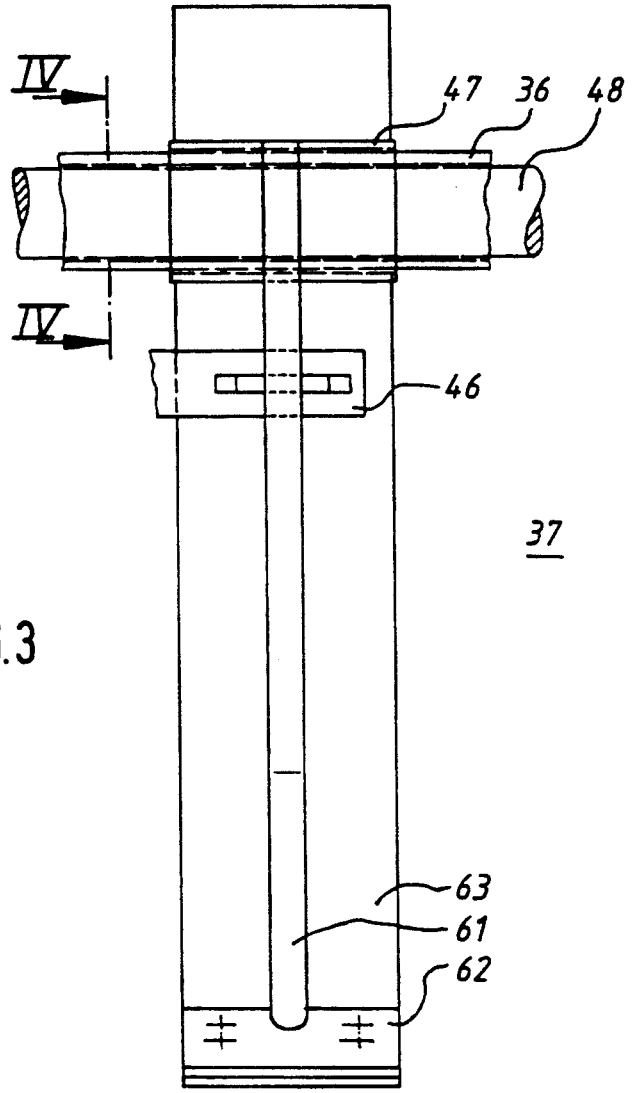
FIG. 3 is a top plan view of one of the shiftable sheet guide elements which makes up the sheet guide assembly.

Referring again to FIG. 2, and also considering FIGS. 3 and 4, a first end of a butt strap 46 is placed about the outer sheet guide element 37. A second end of this butt strap 46 is not specifically depicted but will be understood as being secured to a suitable means for effecting transverse movement of butt strap 46 in the direction indicated by arrow A in FIG. 2 toward or away from the center line 44. This means could be a motor with a threaded spindle, a pneumatic cylinder with a proportioning valve or another similar, generally conventional device.

Figure 5:
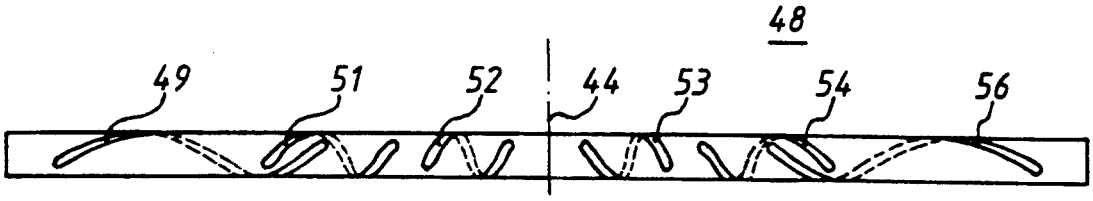
FIG. 5 is a top plan view of the fluted shaft of the adjustable sheet guide assembly of the present invention.

As may be seen most clearly in FIGS. 3 and 4, the individual sheet guide element 37 includes a sleeve or ring 47 which is sized to be concentric with and slidably supported about the hollow profiled body 36. An elongated shaft 48 is rotatably supported within the profiled body 36. As may be seen most clearly in FIG. 5, shaft 48 is provided with a plurality of helical flutes 49, 51, 52; 53, 54 and 56 of varying pitches. These flutes are arranged as mirror images about the center line 44 in a manner similar to the individual shiftable sheet guide elements 37, 38, 39; 41, 42 and 43. The inner most flutes 52 and 53 have the greatest pitch whereas the outermost flutes, all with respect to the center line 44 of the path of sheet travel, 49 and 56 have the smallest pitch.

Returning again primarily to FIG. 4 each sleeve 47, which is square in cross-section similar to and concentric with the square profile of the hollow profile body or tube 36, has a reinforced portion 57 on its lower face with this reinforcement 57 being internally threaded and carrying a guide pin 58. The guide pin 58 extends inwardly through an elongated slit or slot 59 in the profile body 36. An inner end of guide pin 58 is received in helical flute 49 in rotatable shaft 48. As the shaft 48 is rotated, the helical flute will cause the inner end of the guide pin 58 to move in the direction of the longitudinal axis of the shaft 48; i.e. in the direction indicated by arrow A in FIG. 2. Alternatively, movement of the sleeve 47 and hence of the guide pin 58, as by the application of force to the butt strap 46, will cause the shaft 48 to rotate.

The sheet guiding element 37 also includes a bow 61 which is rigidly secured at a first end to the sleeve 47 by, for example, welding. The other or second end of the bow 61 is slightly inclined in its longitudinal axis and receives a clamping element 62 for clamping a metal sheet hold-down member 63, which functions to press a sheet of paper or the like, generally at 64, against the tie bar 3. In operation, as alluded to above, force can be applied to the end of the butt straps 46, which is not specifically depicted, by any suitable means to move butt strap 46 in the direction indicated by arrow A in FIG. 2. The engagement of guide pin 58 in helical flute 49 in shaft 48 causes the shaft to rotate as the guide pin 58 is moved in the direction indicated by arrow A. As the sheet guide element 37 is moved toward its position depicted at 37', the rotation of shaft 48 will cause the other individual sheet guide elements 38, 49; 41, 42 and 43 which, together with element 37 make up the adjustable sheet guide assembly 32 to move toward their inner positions 38', 39'; 41', 42' and 43'. This is due to the engagement of guide pins carried by these individual sheet guide elements with flutes 51, 52; 53, 54 and 56 respectively. Since the pairs of flutes 49 and 56, 51 and 54, and 52 and 53 are mirror images of each other, their respective single sheet guide elements 37 and 43; 38 and 42, and 39 and 41 will move similar distances with respect to each other even though the movement distances of pair 37 and 43 will be different from the movement distances of pairs 38 and 42; and 39 and 41 which will likewise be different from each other. Thus a simple lateral movement of butt strap 46 either toward or away from center line 44 can effect the shifting of the individual sheet guide elements 37, 38, 39; 41, 42 and 43 which make up the adjustable sheet guide assembly 32. The driving force for the butt strap 46 can also be taken from a side register lay which is not specifically depicted in the drawings. Alternatively, a rotary movement could also be applied directly to the shaft 48. Each of the several other adjustable sheet guide assemblies, generally at 23, 24, 26, 27, 28, 29 and 31 will also be adjusted in a similar manner.

In further discussions of the adjustable sheet guide assembly of the present invention, it will be understood that the rotatable shaft 48 has the six helically shaped flutes 49, 51, 52; 53, 54 and 56 on its circumferential surface and that the pitches of the flutes 49, 51, 52; 53, 54 and 56 diminish with increasing distance from the center of the shaft 48 to the ends of the shaft 48, so that the two flutes 49 and 56, 51 and 54 and 52 and 53 have a same pitch. The flutes 49 and 56, which are arranged at each of the ends of the shaft 48 have a pitch angle, which is still below that which would be self-locking. Each of the flutes 49, 51, 52; 53, 54 and 56 has a sleeve or ring 47 associated therewith. Each ring 47 has an attached, ring-fixed guiding pin 58, directed into the interior of the hollow bracket 36, and which extends into and rides in one of the flutes 49, 51, 52; 53, 54 or 56. The center of the shaft 48 or the bisecting center line 44 of the press is understood to be the middle of the maximum format width on a printing unit cylinder. The sleeve 47, shiftably arranged on the circumference of the profile or hollow bracket 36 has a generally annular shape. The profile body or hollow bracket 36 as well as the rings 47, arranged shiftably and form locked on the hollow bracket 36, can have any desired cooperating sections, for example, square, rectangular or hexagon cross section. Normally, there is needed at least one profiled edge-drop shape. By this, there is always provided a locking against a rotation between the ring 47, each carrying a sheet guiding element 37 or a sheet hold down device, and the profile body or hollow bracket 36. It is also possible to manufacture the profile body or hollow bracket 36 as well as the rings 47, which are shiftable thereon, having a hollow, circular profile. In this connection, it is, however, also then necessary to provide a means for preventing relative rotation, by means of a connecting element. This connecting element can consist of a threaded pin, screwed in the radial direction into the circular ring 47, which meshes, with its pin part, force- and form locked into a flute, axially extending in the periphery of the hollow bracket 36.

The shaft 48 can also be a two-part assembly which can be separated in the shaft middle 44. In this case, the drive of the single sheet guide elements 37, 38, 39 is effected by a force that is applied to the actuating sheet guide element 37 in the axial direction A by an actuating cylinder or a side pull lay. The same operative principle is also used for the drive of the sheet guiding elements 43, 42, 41, which are actuated by a force, applied to the sheet guide element 43 in an axial direction to the shaft middle 44.

It is also possible to place between the side wall secured support and the outer sheet guide element 37 an additional element which is similar to the sheet guide element 37, but which has no clamping element 62 and no metal sheet hold-down 63 and which meshes with a guiding pin 58 that extends into and is held in the same outer, helical-shaped flute 49, which is associated with the sheet guide element 37. In this case, a force can be applied in the axial direction to this additional element. An additional element of this type can also be used between the side wall secured support 34 and the other, outer sheet guiding element 42 in the same way.

The movement of the individual sheet guide elements 37, 38, 39; 41, 42 and 43 of the adjustable sheet guide assembly 32 in the axial direction of the shaft 48 can also be accomplished by the direct rotation of the shaft 48. If the shaft 48 is separated into two separate shafts at the center line 44 of the press, both shaft parts will have to be rotated individually and at similar speeds.

In operation, rotation of the shaft or shafts 48 which is provided with the plurality of spaced helically shaped flutes 49, 51, 52; 53, 54 and 56 either directly or indirectly effects an adjustment of the individual sheet guide elements 37, 38, 39; 41, 42 and 43 between their maximum and minimum sheet width positions which are depicted in FIG. 2 in solid and dashed lines, respectively. Either the direct rotation of the shaft 48 or the indirect rotation of the shaft 48, by the application of a force to the butt strap 46, effects the shifting or repositioning of all of the individual sheet guide elements in an expeditious, time efficient manner without the use of a plurality of complex, costly mechanisms.

While a preferred embodiment of an adjustable sheet guide assembly in accordance with the present invention has been set forth fully and completely, it will be apparent to one of skill in the art that a number of changes in, for example the number of printing couples, the sizes of the various cylinders, the overall maximum and minimum widths of the assembly and the like could be made without departing from the true spirit and scope of the present invention which is accordingly to be limited only by the following claims.

What is claimed is:

1. An adjustable sheet guide assembly usable to vary the width of a sheet guide path in a rotary press, said adjustable sheet guide assembly comprising:

a rotary press having sheet travel path with a centerline;

a hollow profiled body extending across said sheet travel path generally transversely to said centerline;

a plurality of sheet guide elements supported on said hollow profiled body for movement along said body generally transversely to said sheet travel path;

a rotatable shaft having a plurality of helical flutes on a peripheral surface, said shaft being supported in said hollow profiled body;

a guide pin on each of said sheet guide elements, each of said guide pins being positionable in a cooperating one of said helical flutes; and means to effect rotation of said rotatable shaft to cause said plurality of sheet guide elements to selectively shift toward and away from said center line of said sheet travel path.

2. The adjustable sheet guide assembly of claim 1 wherein said plurality of helical flutes on a first side of said rotatable shaft with respect to said center line are a mirror image of said plurality of flutes on a second side of said rotatable shaft.

3. The adjustable sheet guide assembly of claim 2 wherein each of said plurality of helical flutes on said first and second sides of said rotatable shaft are of different pitches.

4. The adjustable sheet guide assembly of claim 3 wherein all of said different pitches have pitch angles which are below self locking.

5. The adjustable sheet guide assembly of claim 3 wherein pitch angles of said helical flutes are decreasing towards ends of said rotatable shaft.

6. The adjustable sheet guide assembly of claim 1 wherein said hollow profiled body has an elongated slit and further wherein said guide pins pass through said slit.

7. The adjustable sheet guide assembly of claim 6 wherein each of said plurality of sheet guide elements includes a sleeve, said sleeve being cooperatively shaped with and slidable along said hollow profiled body.

8. The adjustable sheet guide assembly of claim 7 wherein said guide pin on each of said sheet guide elements is secured to said sleeve.

9. The adjustable sheet guide assembly of claim 8 wherein said sleeve on each of said sheet guide elements has an internally threaded reinforcement and further wherein said guide pin on each of said sheet guide elements is secured in said internally threaded reinforcement.

10. The adjustable sheet guide assembly of claim 1 wherein said means to effect rotation of said rotatable shaft includes a butt strap secured to one of said sheet guide elements and selectively shiftable toward and away form said center line.

11. The adjustable sheet guide assembly of claim 7 further including means preventing relative rotation between said sleeve and said hollow profiled body.

12. The adjustable sheet guide assembly of claim 11 wherein said sleeve and said hollow profiled body have cooperating, non-circular cross-sectional shapes.

13. The adjustable sheet guide assembly of claim 1 wherein said rotatable shaft is separated at said center line.

* * * * *